United States Patent [19]

Duverne

[11] 4,244,664

[45] Jan. 13, 1981

[54] METHOD AND APPARATUS FOR ON-SITE TREATMENT OF MUD AND SILT

[76] Inventor: Jean-Claude Duverne, 18, rue des Processions, Linas, F 91310 Montlhery, Essonne, France

[21] Appl. No.: 14,134

[22] Filed: Feb. 22, 1979

[30] Foreign Application Priority Data

Feb. 22, 1978 [FR] France ..... 78 05008
Jan. 5, 1979 [FR] France ..... 79 00205

[51] Int. Cl.[3] ..... E02D 3/12

[52] U.S. Cl. ..... 405/263; 366/345; 405/269

[58] Field of Search ..... 405/263, 264, 265, 269; 366/66, 83, 103, 104, 297, 300, 318, 344, 345; 111/6, 7

[56] References Cited

U.S. PATENT DOCUMENTS

| | | | |
|---|---|---|---|
| 2,917,395 | 12/1959 | Csanyi | 366/66 X |
| 3,408,819 | 11/1968 | Delfosse | 405/269 X |
| 3,877,401 | 4/1975 | Gutman | 111/7 |
| 4,005,853 | 2/1977 | Kimmel | 366/83 |
| 4,058,986 | 11/1977 | Granholm | 405/269 |
| 4,069,678 | 1/1978 | Miura et al. | 405/263 |
| 4,072,017 | 2/1978 | Shiraki | 405/269 X |
| 4,095,535 | 6/1978 | Lely | 111/6 |
| 4,100,861 | 7/1978 | Olsson | 111/7 |

*Primary Examiner*—Stephen J. Novosad
*Attorney, Agent, or Firm*—Rodgers & Rodgers

[57] ABSTRACT

According to this invention, when the area to be treated is accessible, the procedure involves breaking up the soil to be treated by a continuous, forward-moving mixing process down to a chosen depth. A first vertical section of a determined width is followed, with simultaneous forward injection of the reagent. This is continued until the first section has been completed, at which time a second lateral section is begun in the same way. This second section will be exactly adjacent to the first one, which will be in the process of hardening, and the following sections will be completed in the same way until the entire area to be treated has been mixed to the desired depth.

12 Claims, 12 Drawing Figures

METHOD AND APPARATUS FOR ON-SITE TREATMENT OF MUD AND SILT

This invention deals with on-site treatment processing of mud and silt, with the objective of stabilizing and solidifying them by a continuous, forward-moving mixing of these elements, combined with the simultaneous injection of a reagent. This invention also proposes devices suitable for the realization of this process, developed so that they can be mounted on one of two vehicles: on a large-surface carrier when the surface to be treated is accessible, or on the extremity of the boom of a crane or on the arm of an excavator when the bucket has been removed, when the surface to be treated prohibits the use of vehicles other than these. These latter vehicles must remain on the banks of the area to be treated.

For many years, efforts have been made to stabilize and solidify soil which is unfit in its natural state as a foundation for the construction of buildings because of its softness or dampness, and which cannot be solidified by drainage or any other drying-out procedure. Varying techniques have been developed in the field of building and civil works, such as driving in piers or piles, or building thickened slabs. When the ground surface is covered with a sufficiently deep layer of water, other existing procedures make use of specially equipped flat boats carrying complicated equipment, including a probe which is able to stir the upper layers of the submerged soil. At the same time a reagent is injected into the resulting turbulence. These existing procedures are generally very expensive, and cannot be carried out efficiently because of the difficulties of bringing equipment and of feeding the reagent into the site from a distance.

Consequently, one of the main objectives of this invention is to furnish several on-site treatment procedures for weak soils which are unsuitable in their current state for construction purposes. These procedures hae been developed to stabilize and solidify these soils without the necessity of having the large amounts of specialized equipment required by current techniques.

According to this invention, when the work site is accessible, a method for on-site treatment of mud and silt is provided and comprises a mixing process with simultaneous injection of a reagent with the objective of stabilization and solidification. The method includes the breaking up of a first vertical section of a given width of the soil by a continuous forward-moving mixing process down to a given depth while simultaneously injecting the reagent forwardly into the soil until the first section is completed, initiating treatment of a second adjacent section in the same manner and disposed adjacent the first section while the first section is in the process of hardening, and completing subsequent sections in the same manner until the entire area to be treated is mixed to the desired depth.

Also according to this invention, when the work site is inaccessible, the method includes breaking up of a first vertical section of a given width of the soil by a continuous forward-moving mixing process down to a given depth from the banks of solid ground around the soil, beginning the first section on a plane which is inclined in the direction of the forward progress of the mixing, forcing the layers of mixed soil upward in the inclined plane, mixing the lower rear layers at the same time as the upper front layers, continuing the forward progress of the mixing action combined with injection of reagent until the first section extends around the outer edge of the area to be solidified in a complete circle, beginning a second section adjacent to the inner side of the first section and continuing until the second section is enclosed by the first section, and completing the following sections in a similar manner until the entire area has been treated, the central section being comleted last.

In order to carry out the first procedure defined above, this invention proposes a device that consists of a chassis, or frame, supporting a row of parallel mixers, and a set of injector tubes with several openings. These openings face forward and are spread out along the length of the injector tubes. Each injector tube is set between two mixers. Each of the mixers is composed of an endless screw of the auger type, which can be rotated in either direction by an independent motor. This endless screw, when rotated, is longitudinally immobile and does not screw into the body of the chassis, since the screw is designed to create a longitudinal movement of the soil to be treated at the same time as a strong mixing action. This facilitates its complete mixture with the reagent discharged by the nozzles of the injector tubes which surround the screws and which are fastened to the chassis.

This device is also designed to be attached to a vehicle such as a barge or a traction engine which can move about on the surface of the soil to be treated and carry a reagent feeder. The chassis of this vehicle, which supports the mixing machines and the injector tubes, is designed in such a way that it can be positioned so that the mixers and the injector tubes can be set in a vertical, inclined, or horizontal position in the material to be treated. This chassis is also provided with a protective shield attached to its side. This shield occupies the lowest position in the material to be treated.

For the implementation of the second process defined above, the invention calls for a device designed to be used preferably on a telescopic boom of a mobile crane, or at the end of the carrying arm of an excavator, in place of the bucket. This device has a rectangular chassis provided with long lateral plates and having at least two helicoidal endless screws, each rotated by an independent motor. The extremities of the endless screws rotate in bearings attached to the sides of the chassis. These screws are on either side of an injector tube for the reagent, which is set transversally in the chassis. The chassis has a median longitudinal brace that supports the injector tube, and this brace extends upward to become a carrying arm of the chassis. At the end of this arm is a pivot which can turn, and which is designed to fit on to the end of the boom or the arm of the machine, which bring this chassis into working position and support it.

This device also includes a rigid connector, adjustable in length, with a joint at each end. It joins one point, which is located on the above-mentioned arm or boom of the machine, at a specific distance from the revolving pivot to another point on the brace of the chassis, located forward of the pivot. This rigid connector is designed to push and pull as necessary to bring the above-mentioned chassis into an inclined position. The chassis is facing forward, with the lower section slightly ahead of the upper section, which supports the motors that rotate the endless screws.

In addition, the chassis of this apparatus is designed to support a second chassis that would extend from its lower section. This second chassis is similar, but does not have motors which rotate its endless screws. The upper extremity of the shaft of each of the screws is designed to fit the lower end of the shaft of the corresponding screw of the first chassis.

Also, on these chassis, the lower extremity of each of the shafts of the endless screws is designed to fit on to the extension of an endless screw; in the same way, the lower end of the injector tube can be joined to an extension. These extensions are long enough to be able to follow the slope of the more solid banks of the area of soil to be treated, for example, at the time that solidification treatment is begun for the first section of soil.

The chassis of this device is also designed so that an identical chassis can be joined to one or both of its longitudinal sides. This identical chassis, provided with motors that rotate the endless screws, is added when it is possible to treat a larger section of soil, which depends on the nature of the section itself.

It should also be noted that each motor that rotates an endless screw is designed to rotate the screw so that the layers of soil to be treated are broken up in an upward pattern. The motors are preferably electric ones with a waterproof housing, controlled from the cabin of the machine. The machine also pulls in its wake a flexible electric cable which is connected to a feeder located at a distance. Concerning the injector tube(s), the cabin of the machine also controls the reagent that they receive under pressure, and the machine pulls in its wake a hose connected to a distant feeder pump. The endless screws can also be streamlined, depending on the viscosity of the mud to be treated.

The following is a description of some other characteristics of the above-defined devices which carry out the soil treatment processes. The numbers correspond to the attached drawings.

Figure 5:
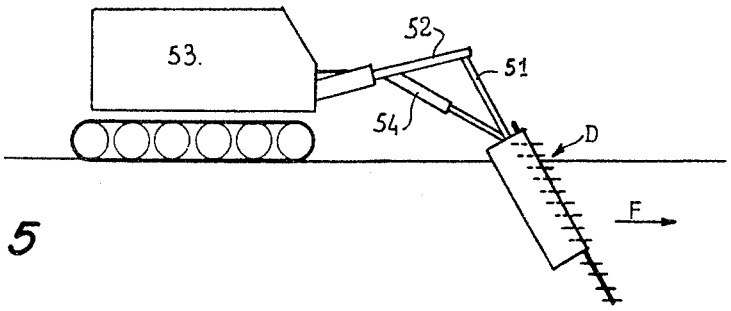

FIG. 5 is a view in elevation of a machine supporting the apparatus in an inclined position. The machine is moving forward in the direction indicated by the arrow F. The machine for caryring out the second treatment procedure is in this example a mobile crane on caterpillar wheels with a telescopic boom.

Figure 6:
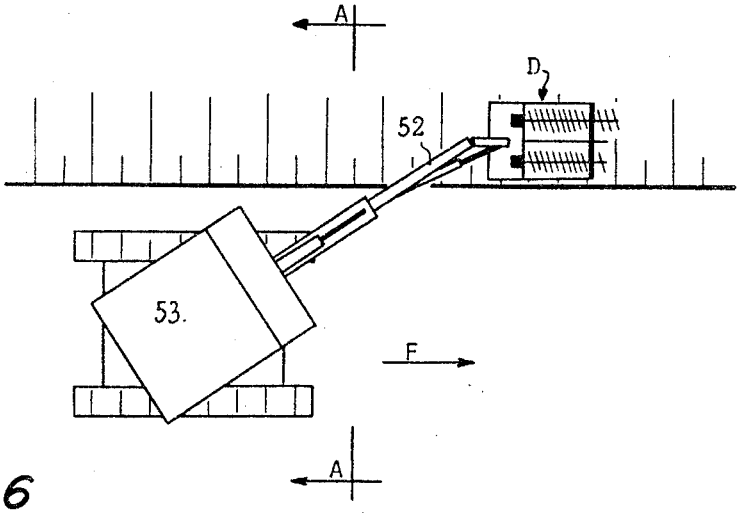

FIG. 6 is a planar view of the working position of the device shown in FIG. 5.

Figure 7:
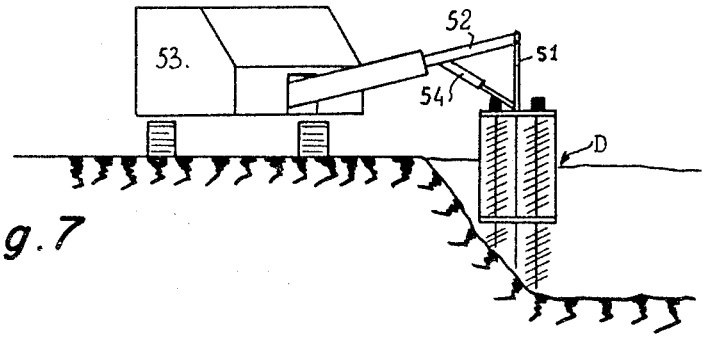

FIG. 7 is a front view of the working position of the device shown in FIG. 6, following arrows A—A.

Figure 8:
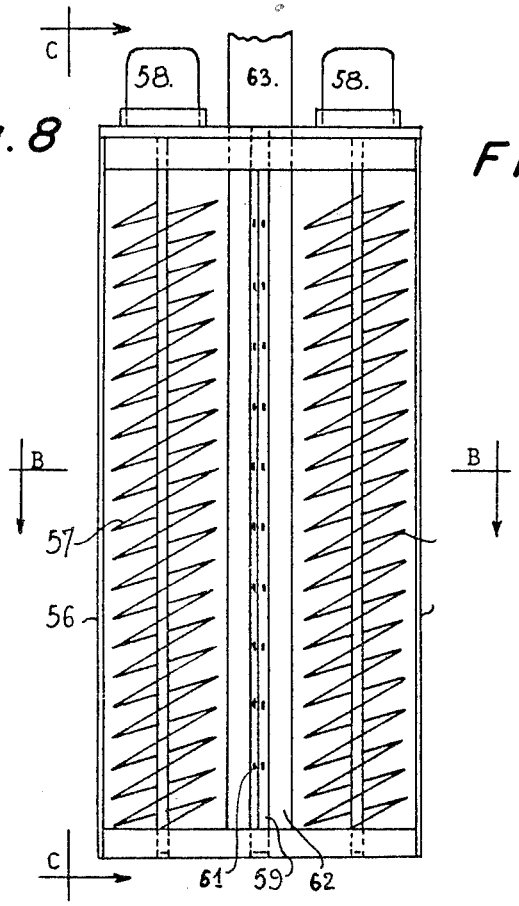

FIG. 8 is a schematic front view of the device, supported by a machine and designed to carry out the second procedure.

Figure 9:
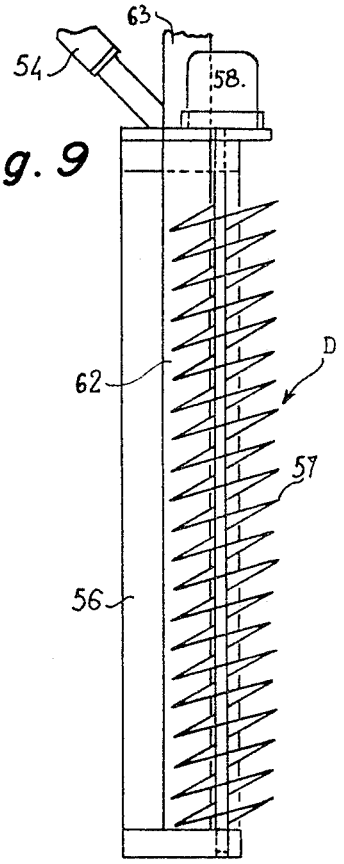

FIG. 9 is a side view of the device shown in FIG. 5, following lines C—C.

Figure 10:
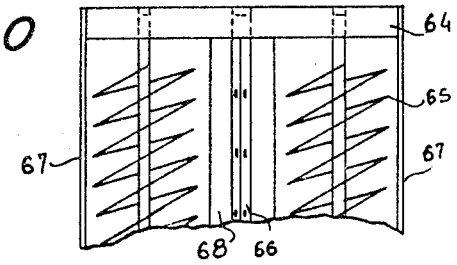

FIG. 10 is a partial front view of the top portion of a second chassis of a device which can be assembled underneath the main chassis shown in FIG. 8.

Figure 11:
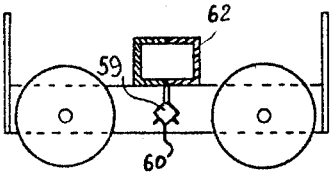

FIG. 11 is a cross—section following B—B of the main chassis of FIG. 8.

Figure 12:
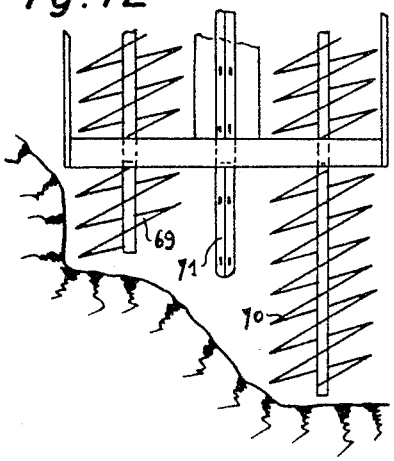

FIG. 12 is a front view of the lower part of either chassis of FIGS. 8 and 10, showing the endless screw extendors and the injector tube extendors, which can be adapted to work a section of soil along the inclined edges of a work site to be treated.

Figure 1:
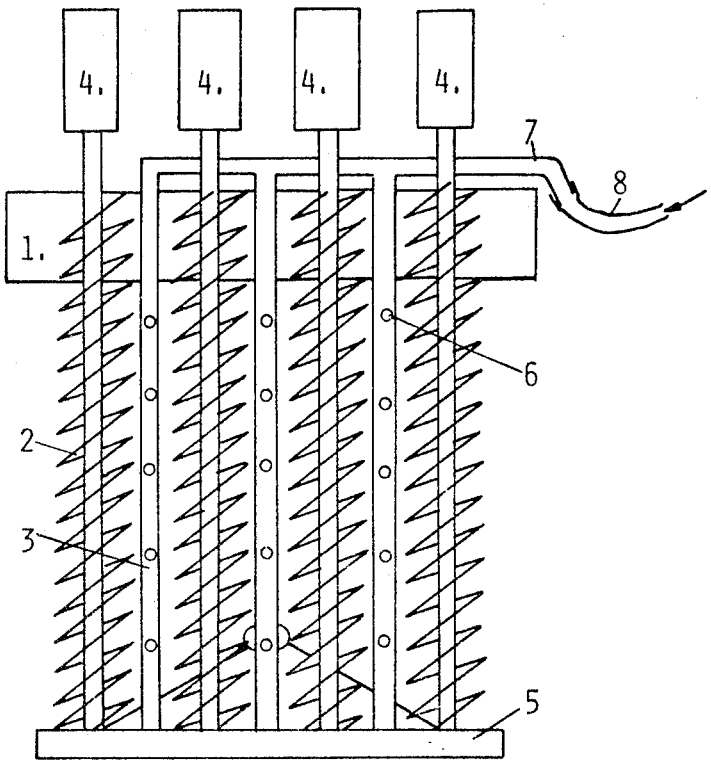
FIG. 1 shows, in elevation, the device designed to carry out the first treatment procedure.

Using FIG. 1 as a reference, the device shown has a chassis or frame, to which are attached at least one agitator 2 and one injector 3. The apparatus as shown has been assembled with agitators 2 of the auger type, which are rotated by motors 4. One end of the rotating shafts is attached to the motor, and the opposite end is inserted into a part of a protective shield 5. A set of injectors 3 is made up of tubes with openings 6 regularly spaced along their length. The tubes are located between the agitators 2, and they are parallel to the agitators. One end of the tube is attached to the frame 1 and the other end is attached to the shield 5. A feeder tube 7 joins the openings of the injector tubes 3 to the end of a pressurized pipe 8 which carries the reagent.

Figure 2:
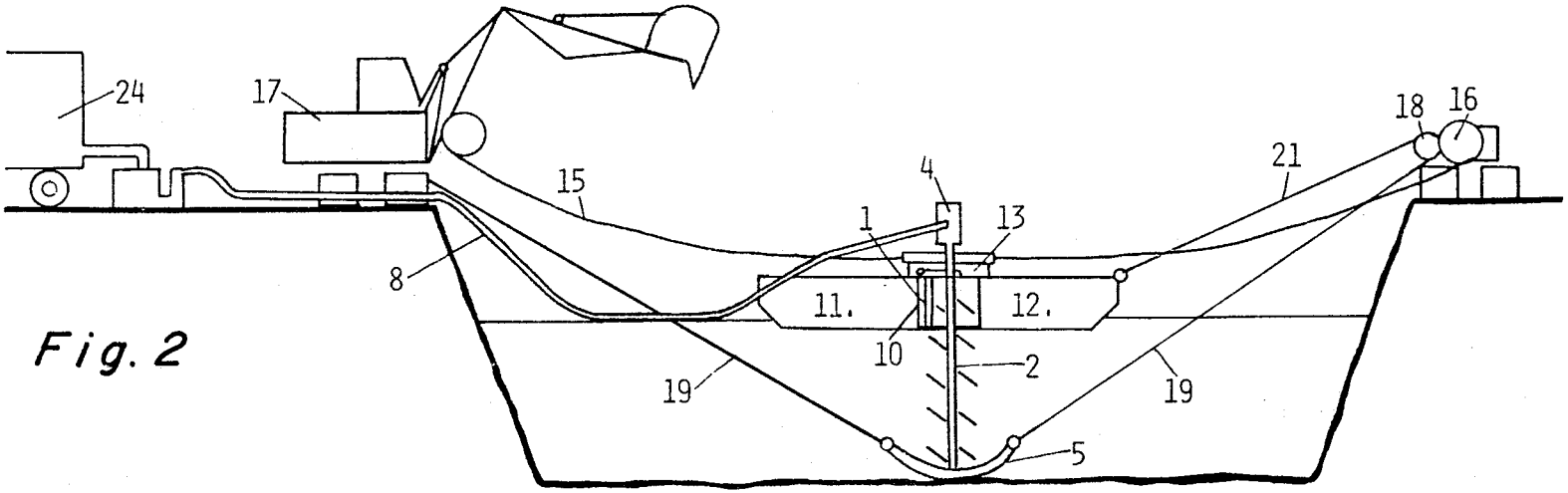
FIG. 2 is a schematic representation of the mixing set-up, with the FIG. 1 apparatus installed between two barges.
Figure 3:
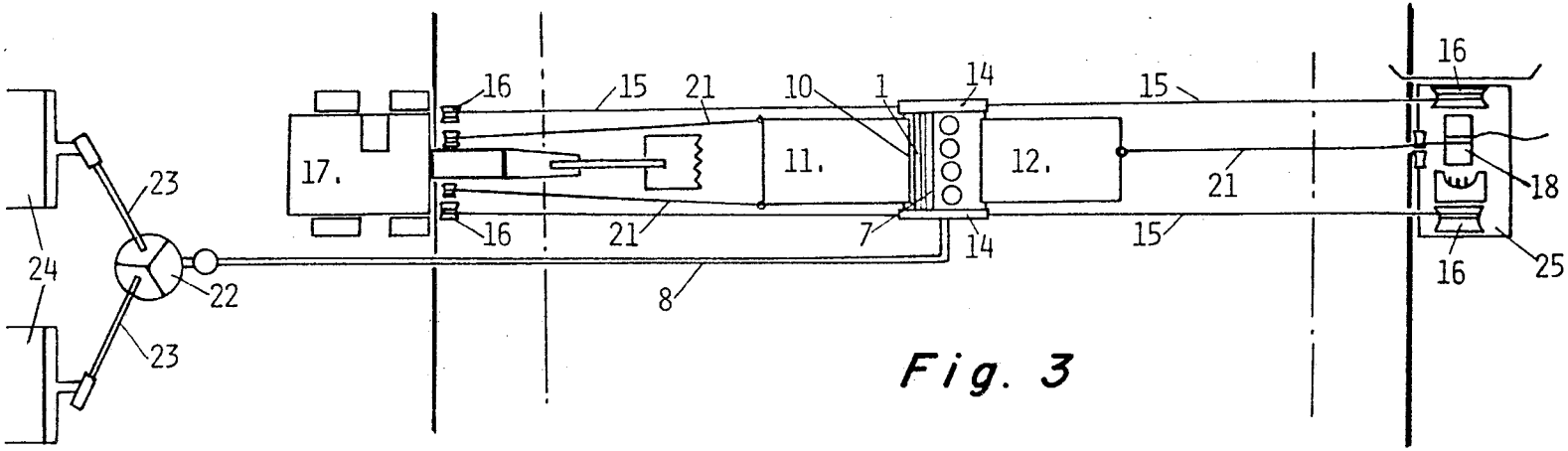
FIG. 3 shows a planar view of FIG. 2 in operation.

One alternative in assembling the apparatus is to set the axes of the agitators and the injector tubes vertically. A utilization procedure is given here as an example, referring to FIGS. 2 and 3.

The apparatus is attached by its frame 1 to the rear side 10 of a barge 11. The other side of this apparatus faces the rear of another barge 12. The two barges are joined by two plates 13, which form an extension of their lateral sides. These plates are topped by a guiding tube 14, and a cable stretched between two capstans goes through each of them. The capstans are placed on the banks of the site, on solid ground, and attached to inert objects, shown here as an excavating machine 17 or a bulldozer 25 and a winch 18. Two other cables 19 attached to the ends of the lower shield 5 enable the shield to remain in place when the entire apparatus is in position. A cable 21 is attached to the end of the barges 11 and 12 and wound around the winches 18 so that the barges can be moved from one bank to the other, from the opposite bank to the machine. The pressurized pipe 8 fitted onto the end of the feeder tube 7 of the injector tubes 3 (see FIG. 1) is extended to one of the banks of the work site, where it is connected to a mixing tank 22. This mixing tank is fed by pipes 23, which carry the reagent—of the Petrifix type, for example—from the reservoirs 24 in which it is stored.

When it is being used, the reagent contained in one or the other of the reservoirs 24 arrives in the mixing machine 22 and goes first into the pressurized pipe 8, then into the feeder tube 7, and finally into the injector tubes 3. The reagent is distributed by the openings 6, through which it is distributed among the auger blades 2. The auger blades, driven by the motors 4, mix the soil with the reagent long enough so that the hardening process begins. The plates 13, fitted between the barges 11 and 12, limit the size increase of the mixture, while at the same time allowing for draining off of excess. Then the two barges 11 and 12 can be moved by the cable 21 and pulled by the winch 18, so that the operation can be continued in another location.

Figure 4:
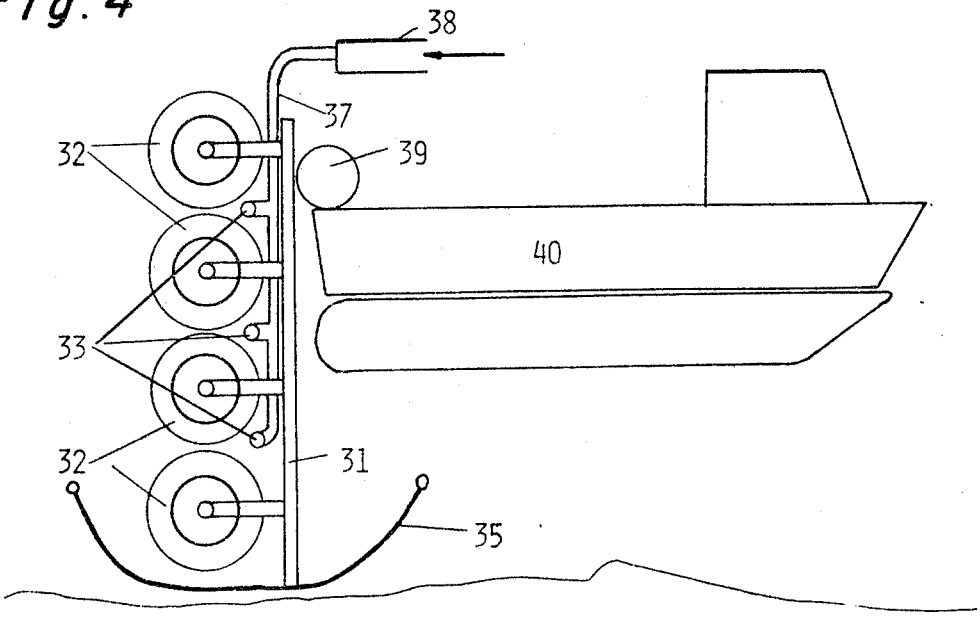
FIG. 4 is a schematic representation of a partial view of a mixing operation with the FIG. 1 device, mounted on a traction engine.

In a second use of the apparatus shown in FIG. 4, agitators 32 and injector tubes 33 are used, with their axles in a horizontal position; a feeder tube 37 is in a vertical position, and so is the largest side of a frame 31. The lower end of this frame has a protective shield 35.

This set-up is especially adaptable to another use, also shown in FIG. 4, in which the device is attached by its frame 31 onto a traction engine 40, with the use of a raising device 39 such as a winch or a toothed rack.

The procedure is exactly the same as described previously, with feeding of the reagent through a pipe 38. This arrangement is more suitable for the treatment of soil that is not as liquid in consistency as in the preceding case. It has the following advantage: since the depth to which the apparatus is extended into the soil can be adjusted by the raising device 39, the apparatus can be adapted as necessary to the exact depth of the bed of soil.

As can be seen in FIGS. 5 through 7, the second on-site treatment procedure of soft soil is carried out by using a device D, suspended by a movable, hinged pivot 51, that is attached to the end of the telescopic boom 52 of a crane 53 with traction wheels. This machine follows arrow F along the bank of the area of soil to be treated, with its arm 52 positioned diagonally to this bank, and maintains the apparatus D in a plane which is perpendicular to the direction of movement, and at the same time inclined so that the lower end of apparatus D is located slightly forward of the upper end. This incline can be adjusted as necessary by a rigid connector 54 which consists of a cable controlled from the cabin of the machine, and which can be moved forward and backward as necessary in order to maintain the apparatus D in its working position.

As can be easily understood by looking at FIGS. 5 through 7, the second procedure is begun by the treatment of the inside edge of the soil area to be treated, following a section which is as wide as the apparatus D itself. Thus the machine follows along the perimeter of the area to be treated. When this first section is completed and the apparatus is back to its point of departure, the machine continues moving along the beginning of the section which is now solidified, or almost so, with apparatus D in a working position identical to its initial one. A second section is then begun, following the inside bank of the first section completed, until the machine arrives at the beginning of the first section. The machine then crosses to the beginning of the second completed section. The procedure is continued in the same way until treatment of the entire area is complete. The central section of the area is done last.

In FIGS. 8 through 12, there is a diagram of the utilization of apparatus D for carrying out the second procedure. This set-up consists of a rectangular chassis 55 with lateral plates 56, and including two helicoidal endless screws. Each of these screws is controlled by an independant motor 58. The ends of the shaft of each screw are pivoted in bearings or pillow-blocks (not shown) attached to the sides of the chassis 55. These screws are on either side of an injector tube 59 for the pressurized reagent, preferably consisting of a square tube with one edge 60 facing the soil to be treated. This tube 59 has openings for injection 61 located on the entire length of the sides of the tube adjacent to the above-mentioned frontal edge 60. This tube is also attached to a longitudinal median brace 62 found on the chassis 55. The upper end of this brace is extended by a carrying arm 63. This carrying arm has a movable pivot 51 at its upper end. This pivot can be oriented and is designed to fit on to the end of the boom 52 of the machine. As is best seen in FIGS. 5, 6, 7, and 9, the chassis can be brought into an inclined working position using the cable 54. The independant motors—preferably electric—which rotate the screws, do this in such a way that the layers of soil to be treated are mixed at the same time as they are forced upward, and at the same time the reagent is injected under pressure.

FIG. 10 shows the upper portion of a complementary chassis 64 that can be fitted to the lower portion of the main chassis 55. It is easy to see that the lower extremity of the shafts of the screws 57 can be fitted onto the upper extremity of the screws 65 of the chassis 64. There are no motors on this chassis, and its screws are rotated by the screws 57. In the same way, the top of the injector tube 66 can be fitted on to the bottom of the injector tube 59. Although not shown, the lower end of the plates 56 can be fitted to the upper end of the plates 67, and the lower end of the brace 62 can be assembled to the upper end of brace 68, so that the complementary chassis and the main chassis become one unified structure.

As can be easily seen in FIG. 12, the lower end of the shafts of the endless screws and of the injector tubes of these two chassis is also designed so that extensions of screws 67 and 70 and an extension 71 of the injector tube can be fitted on when an inclined bank of soil just be solidified.

It is also to be noted that these chassis are designed to be able to carry other chassis (not shown) on their sides, when a larger section of soil is to be treated, if of course the consistency of the soil allows this.

I claim:

1. A method for on-site treatment of mud and silt by a mixing process with simultaneous injection of a reagent for the purposes of stabilization and solidification, the method comprising breaking up of a first vertical section of a given width of the soil by a continuous forward-moving mixing process down to a given depth while simultaneously injecting said reagent forwardly into said soil until said first section is completed, initiating treatment of a second adjacent section in the same manner and disposed adjacent said first section while said first section is in the process of hardening, and completing subsequent sections in the same manner until the entire area to be treated is mixed to the desired depth.

2. A method for on-site treatment of mud and silt wherein the work site is relatively inaccessible by a mixing process with simultaneous injection of a reagent for the purposes of stabilization and solidification, the method comprising breaking up of a first vertical section of a given width of the soil by a continuous forward-moving mixing process down to a given depth from the banks of solid ground around said soil, beginning said first section on a plane which is inclined in the direction of the forward progress of the mixing, forcing the layers of mixed soil upward in said inclined plane, mixing the lower rear layers at the same time as the upper front layers, continuing the forward progress of the mixing action combined with injection of reagent until said first section extends around the outer edge of the area to be solidified in a complete circle, beginning a second section adjacent to the inner side of said first section and continuing until said second section is enclosed by said first section, and completing the following sections in a similar manner until the entire area has been treated, the central section being completed last.

3. Apparatus for on-site treatment of mud and silt by mixing them in a continuous feed with a simultaneous injection of a reagent product in order to stabilize and solidify said mud and silt comprising a chassis supporting a row of parallel mixers and a set of injector tubes having several openings, said openings facing forward and disposed along the length of said injector tubes, each injector tube disposed between two mixers and adapted for the discharge of said reagent through said openings, each mixer comprising endless auger type screw which can be rotated in either direction by an independent motor, said endless screw when rotated being longitudinally immobile, said screw designed to create longitudinal movement of the soil to facilitate complete mixture with said reagent, and said apparatus being adapted for vertical or horizontal operation.

4. Apparatus according to claim 3 and adapted to be attached to a vehicle such as a barge or a traction engine which can move around the surface of the soil to be treated, said mixers and said injector tubes adapted for disposition in a vertical, inclined, or horizontal position in the material to be treated, said chassis provided with a protective shield, and said shield occupying the lowest position in the material to be treated.

5. Apparatus for on-site treatment of mud and silt and adapted for use preferably on a telescopic boom of a mobile crane or at the end of the carrying arm of an excavator comprising a rectangular chassis provided with long lateral plates, at least two helicoidal endless screws each rotated by an independent motor, the extremities of said endless screws rotatable in bearings attached to the sides of said chassis, at least one injector tube adapted to disperse a reagent, said screws disposed on either side of said injector tube, said chassis having a median longitudinal brace supporting said injector tube, said brace extending upward to become a carrying arm of said chassis, and at the end of said arm a pivot adapted to fit onto the end of said boom or said arm of the machine which brings said chassis into a working position.

6. Apparatus according to claim 5 and further comprising a rigid connector adjustable in length with a joint at each end and joined at one point on said arm or boom at a specific distance from said pivot and to a point on said chassis forward of said pivot, said rigid connector designed to push and pull as necessary to bring said chassis into an inclined position, and said chassis facing forward with the lower section slightly ahead of the upper section supporting the motors that rotate said endless screws.

7. Apparatus according to claims 5 or 6 and further comprising said chassis designed to support a second chassis extending from its lower section, multiple endless screws associated with said second chassis, and the upper extremity of the shaft of each of said screws associated with said second chassis designed to fit the lower end of the shaft of the corresponding screws of said chassis.

8. Apparatus according to claim 7 and further comprising said second chassis having at least one injector tube, the lower extremities of said injector tube and said endless screws of said second chassis being long enough to follow the slope of the more solid banks of soil to be treated.

9. Apparatus according to claim 5 and further comprising said chassis having an identical chassis joined to at least one of its longitudinal sides, said identical chassis having endless screws, and said identical chassis having motors that rotate said endless screws for treating a larger section of soil.

10. Apparatus according to claim 5 and further comprising motors adapted to rotate said endless screws so that the layers of soil to be treated are broken up in an upward pattern, said motors being electric with a waterproof housing and being controlled from the cabin of said machine, and said machine pulling in its wake a flexible electric cable connected to a feeder located at a distance.

11. Apparatus according to claim 5 and further comprising said machine pulling in its wake a hose connected to a distant feeder pump.

12. Apparatus according to claim 5 and further comprising said endless screws being streamlined depending on the viscosity of the mud to be treated.

* * * * *